US005655587A

United States Patent [19]

Kraler

[11] Patent Number: 5,655,587

[45] Date of Patent: Aug. 12, 1997

[54] ROLLER BLIND SYSTEM

[76] Inventor: Franz Kraler, A-9913, Abfaltersbach 125, Austria

[21] Appl. No.: 665,962

[22] Filed: Jun. 17, 1996

Related U.S. Application Data

[63] Continuation of Ser. No. 314,237, Sep. 28, 1994, abandoned .

[30] Foreign Application Priority Data

Oct. 11, 1993 [AT] Austria ..... 2031/93

[51] Int. Cl.[6] ..... A47H 1/00

[52] U.S. Cl. ..... 160/31; 160/270; 160/903

[58] Field of Search ..... 160/270, 23.1, 160/26, 31, 32, 33, 903, 133, 323.1, 271, 272, 273.1, 40, 41

[56] References Cited

U.S. PATENT DOCUMENTS

| | | | |
|---|---|---|---|
| 2,041,105 | 5/1936 | Barnhart | 160/31 |
| 3,068,937 | 12/1962 | Christensen | 160/26 X |
| 4,168,734 | 9/1979 | Holmqvist et al. | 160/23.1 |
| 4,234,032 | 11/1980 | Stark | 160/26 |
| 4,726,409 | 2/1988 | Besler | 160/23.1 |
| 5,067,540 | 11/1991 | Besler | 160/23.1 |
| 5,070,925 | 12/1991 | Paule | 160/23.1 |

FOREIGN PATENT DOCUMENTS

| | | | |
|---|---|---|---|
| 352369 | 9/1979 | Austria | E06B 9/02 |
| 772321 | 10/1971 | Belgium | E06B 9/17 |
| 150000 | 7/1985 | European Pat. Off. | E06B 9/20 |
| 254922 | 2/1988 | European Pat. Off. | E06B 9/20 |
| 2225037 | 10/1974 | France | E06B 9/20 |
| 2343117 | 9/1977 | France | E06B 9/17 |
| 2403445 | 9/1977 | France | E06B 9/17 |
| 2403445 | 4/1979 | France | E06B 9/17 |
| 2425530 | 12/1979 | France | E06B 9/17 |
| 2520431 | 7/1983 | France . | |
| 2635141 | 10/1990 | France | E06B 9/174 |
| 2806554 | 8/1979 | Germany . | |
| 2612318 | 6/1981 | Germany | E06B 9/17 |
| 8914394 | 3/1990 | Germany | E06B 9/17 |
| 4002250 | 8/1991 | Germany | E06B 9/17 |
| 4106390 | 9/1992 | Germany | E06B 9/58 |
| 63906 | 9/1971 | Luxembourg | E06B 9/17 |
| 619285 | 9/1980 | Switzerland | E06B 9/17 |

*Primary Examiner*—David M. Purol
*Attorney, Agent, or Firm*—Lorusso & Loud

[57] ABSTRACT

A roller blind system with a roller blind draw-up or mounting assembly supported by lateral carrier members. Lateral guide rails for guiding the roller blind shuttering are connected to the lateral carrier members by separate connecting elements. The separate connecting elements facilitate selection or adjustment of the respective lateral positions of the guide rails and carrier members.

12 Claims, 5 Drawing Sheets

A'
20a
20a
20
A'

20

21

22

23

24
B
B
24a
24b 24a
24b 13
24a

20

ROLLER BLIND SYSTEM

CROSS REFERENCE TO RELATED APPLICATIONS

This is a continuation of application Ser. No. 08/314,237, filed Sep. 28, 1994, which is now abandoned.

FIELD OF THE INVENTION

The invention concerns a roller blind system with lateral carrier members for a draw-up mechanism, a mounting or the like, and with lateral guide rails for the roller blind shuttering. The guide rails can each be connected to a respective lateral carrier member, by two or more connecting elements which are different or which can be adjusted differently. The connecting elements are separate from the guide rails and the carrier members, and are respectively provided for connecting a guide rail and a carrier member. The connecting elements can be selected or adjusted in dependence of in the respectively desired relative position of the guide rail and the carrier member.

DESCRIPTION OF THE PRIOR ART

In roller blind systems in accordance with the state of the art, lateral carrier members (cover caps) carry the draw-up or raising mechanism, or a mounting for the winding shaft, of a roller blind shuttering or shield arrangement. Provided integrally on those lateral carrier members are downwardly projecting connecting elements, by means of which the lateral carrier members can be fitted onto lateral guide rails. The lateral guide rails are, for example, screwed to the door or window frame, and serve to guide the roller blind shuttering. The disadvantage of such a connecting element which is formed integrally with the carrier member is that the draw-up element of the draw-up mechanism, for example a belt or a crank handle, can only be extended out of the roller blind casing structure either to the right or to the left from the connecting element. Relative to the outside edge of the guide rail, therefore, that arrangement always involves a spacing in respect of the draw-up elements towards the right or towards the left. In particular, it is not possible for those draw-up elements to be extended out of the roller blind casing structure without a lateral spacing relative to the outside edge of the guide rail (apart from using complicated belt direction-changing mechanisms or a universal joint arrangement which is of an expensive and complicated construction). If the draw-up element is to be extended laterally outside the carrier members, it is additionally necessary to displace the winding-up mechanism outwardly and to provide an additional cover means, which, in turn, represents increased cost.

SUMMARY OF THE INVENTION

Therefore, the object of the invention is to provide a roller blind system of the general kind set forth in the opening part of this specification, with which the relative lateral position as between the carrier members and the respective guide rails can be adapted in a simple manner to the respective conditions involved.

In accordance with the invention, in a roller blind system of the general kind set forth in the opening part of this specification, the relative lateral position as between guide rails and carrier members is adjustable by way of the separate connecting elements.

As, in accordance with the invention, the connecting element is no longer formed integrally with the lateral carrier members, it is possible by the use of different connecting elements or adjustable connecting elements easily to adapt the relative lateral position as between a respective lateral carrier member and the lateral guide rail connected thereto to the respective conditions involved, in which case the carrier members and the guide rails themselves can, in principle, always by of the same configuration for such adaptation. By way of adaptation of the relative lateral position as between carrier member and guide rail, it is possible for the draw-up element (for example belt or crank handle), which extends from the draw-up mechanism which is fixed to the carrier member, to be adjusted in respect of its position relative to the outside edge of the guide rail. In particular, it is possible for the draw-up elements to be passed out of the roller blind casing structure without a lateral spacing relative to the outside edge of the guide rail, without expensive direction-changing mechanisms being required. It is particularly desirable, in regard to easy adaptability to the respective conditions concerned and replacement as required of the parts involved, if the separate connecting elements can be respectively connected releasably to the carrier member and/or releasably to the guide rail.

It is particularly advantageous if a plurality of different separate connecting elements are already available for the fitter or planner of a specific roller blind. Then, depending on the local conditions involved, it is only necessary to select for each carrier member or for each guide rail a specific one of those separate connecting elements, and to use it for connecting the guide rail and the carrier member. The connecting elements of such a set of connecting elements may be, for example, of an I-shaped or Z-shaped profile, wherein the Z has two vertical limbs and a horizontal limb. The lateral displacement between the carrier member and the guide rails can then be readily adapted by way of the length of the horizontal limb.

In principle, however, it is also possible for the separate connecting element to be of a two-part or multi-part structure, wherein at least two parts are adjustable relative to each other. This also permits fine adaptation of adjustment on site.

Besides sets of different separate connecting elements the roller blind system according to the invention may advantageously include a plurality of different left-hand and right-hand guide rails, the connecting region of which, however, is always of the same configuration so that it matches the separate connecting elements. This makes it possible to provide, in the manner of a modular system, for adaptation to different conditions in the region of the guide rails. For example, adjustments may be made according to the nature and thickness of the roller blind shuttering or shield arrangement, the nature of the fixing to the door frame or to the wall etc, while the same type of separate connecting elements can be used for all guide rails.

That problem can be solved in terms of structure by a two-part or multi-part guide rail. One part has a connecting region which is always of substantially the same design configuration, for the separate connecting element. The second part is connected to the first part, and can be adapted to the respective conditions involved.

The modularity of the roller blind system according to the invention can relate not only to different separate connecting elements and different guide rails which match, but also a plurality of different carrier members which can be selectively fixed to the guide rails. The different carrier members, in turn, have connecting regions or mounting means of the same kind which match all separate connecting elements. Overall, therefore, it is possible to construct a roller blind system which is modular in three aspects, and in which a plurality of different carrier members, a plurality of different or adjustable connecting elements, and a plurality of different guide rails are available, which can be combined together as desired to permit simple adaptation to the respective requirements involved.

Further advantages and particulars of the invention are described in greater detail with reference to the following specific description.

DESCRIPTION OF THE PREFERRED EMBODIMENT

Figure 1:
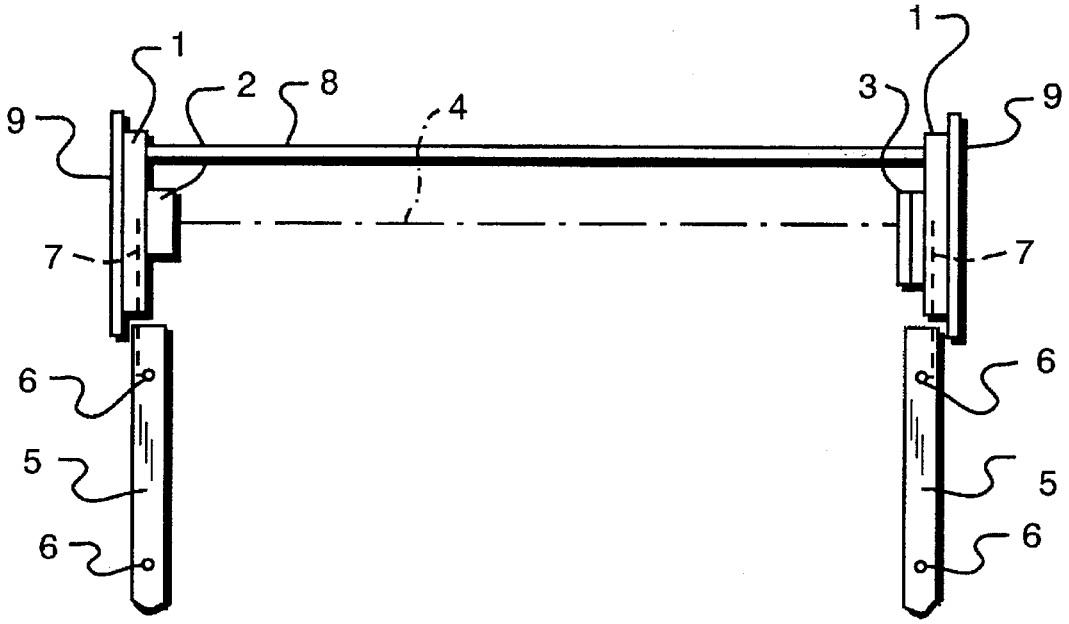
FIG. 1 is a front plan view of a roller blind system according to the present invention.

The roller blind shown in FIG. 1 has two lateral carrier members 1 which carry a mounting 2 or a draw-up or raising mechanism 3. A winding shaft with axis 4 can be driven by way of the draw-up mechanism 3 and a draw-up element (not shown), and, thus, a roller blind shuttering (also not shown) can be wound up. The roller blind shuttering is guided in lateral guide rails 5 which are fixed, for example, by means of fixing screws 6 to a door or window frame. The carrier members 1 are releasably connected to the guide rails 6 by way of separate connecting elements 7. In FIG. 1 the separate connecting elements are illustrated only diagrammatically by broken lines. A closer description thereof is set forth in relation to FIG. 5 through 10*c*.

If the winding shaft is not enclosed by a roller blind casing structure, it may be desirable, for the purposes of enhancing stability, if the two carrier members 1 are connected together by a connecting bar 8.

The roller blind shown in FIG. 1 is, in principle, suitable both as a built-in roller blind and also as a finished or ready-made roller blind, in which respect all operationally important elements can be the same in both cases. In the case of a built-in roller blind, the carrier members 1 are fitted in an already existing compartment or opening in the window or door lintel member, and possibly downwardly faced. The entire draw-up mechanism together with the carrier members and the winding shaft is, therefore, scarcely visible. In that case the two carrier members can be arranged completely unencased in the receiving compartment or opening. If, however, the roller blind is to be used as a so-called ready-made roller blind which is typically subsequently fitted above windows or doors in such a way as to be visible from the outside, it is easily possible to mount an end cover 9 externally at each carrier member 1, without altering the other structurally and operationally important elements. Furthermore, a roller blind casing structure wall may be provided between the two covers 9 in order to conceal the winding shaft, the mounting 2, and the draw-up mechanism 3 in the interior. It is also possible for different kinds of covers 9 to be fixed on the outside to the respective carrier member, for the same roller blind system, with the same or similar carrier members 1.

Figure 2:
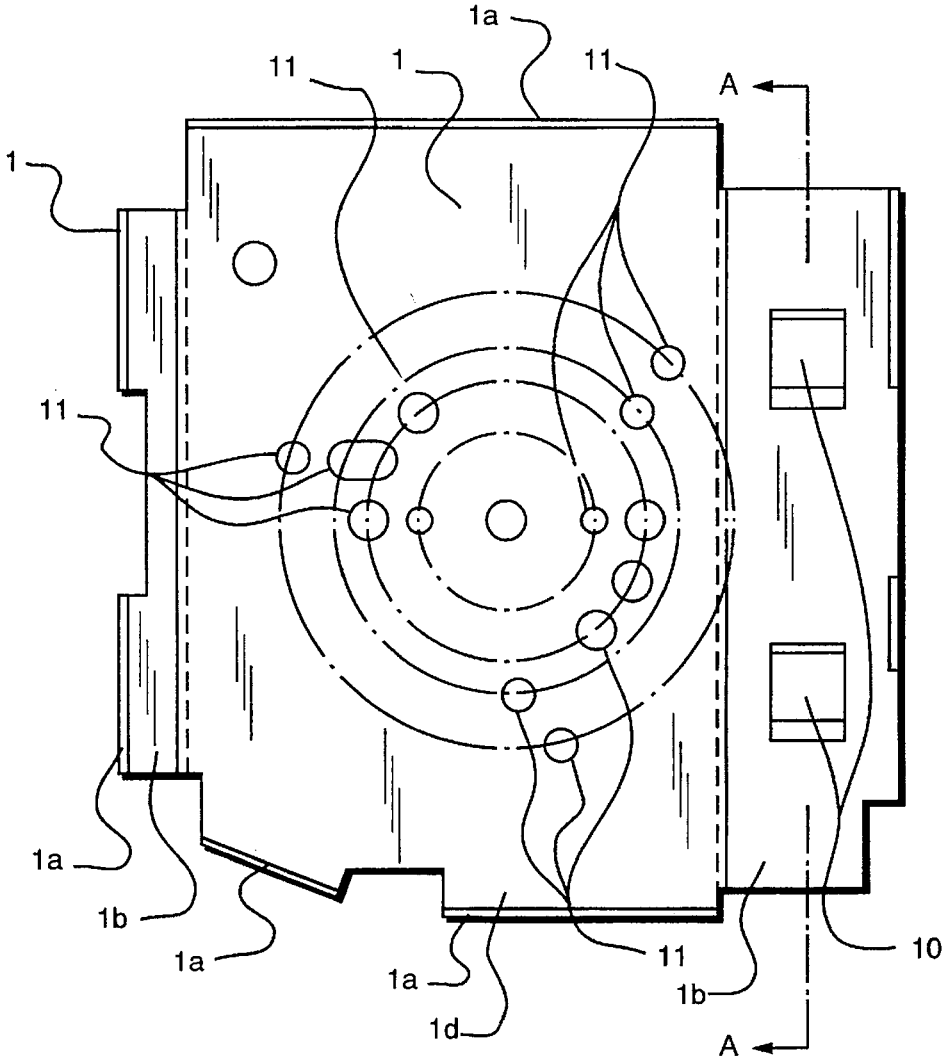
FIG. 2 is a side plan view of a lateral carrier member according to the present invention.
Figure 3:
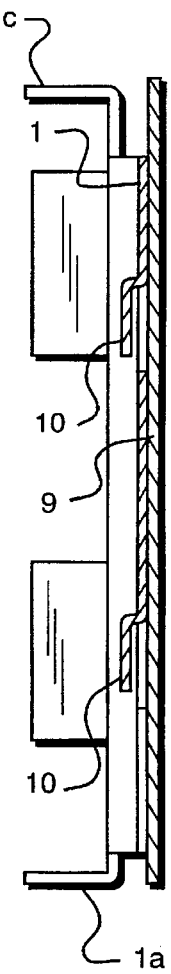
FIG. 3 is a sectional view of the lateral carrier member of FIG. 2 taken along lines A—A.
Figure 4:
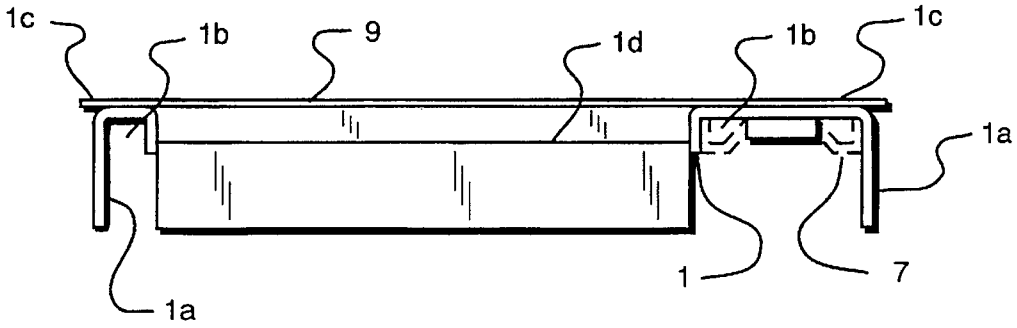
FIG. 4 is a top plan view of the lateral carrier member of FIG. 2.

The carrier members 1 may be, for example, of the configuration shown in FIGS. 2 through 4. The carrier members 1 illustrated therein are integral and comprise stamped sheet metal. That means that they are easy and inexpensive to produce. In order to enhance stability the carrier member 1 have angled legs at the edge. They also permit easy fixing to a wall forming the roller blind casing structure, between two lateral carrier members 1. On the left and on the right in FIGS. 2 and 4, the carrier members 1 have profile channels 1*b* for enhancing stability. The profile channel 1*b* which is at the right in FIGS. 2 and 4 also serves to receive a connecting element 7, as is shown, for example, as element 20 in FIGS. 8*a* through 8*c*. The connecting element 7 serves to connect the carrier member 1 to the guide rails 5. In order to provide for a stable connection of the connecting element 7 to the carrier member 1, two lugs 10 are stamped out in the carrier member 1 and are bent inwardly and downwardly within the profile channel 1*b*. The connecting element 7 has openings at the spacing of the two lugs 10 and can thus be inserted from below into the lugs.

At a region 1*d* which is set back relative to the end faces 1*c*, the carrier member shown in FIGS. 2 through 4 has a plurality of through openings 11. The draw-up mechanism, the mounting or the like can then be screwed from the outside through the through openings 11 to the carrier member 1, in which case the screw heads do not project beyond the faces 1*c*. That makes it possible for simple flat cover plates 9 to be mounted to the end faces 1*c*, if that is advantageous for visual or technical reasons. The cover plate 9 can preferably be screwed or glued to the carrier member 1, but releasable connections are certainly also conceivable and possible.

It is possible for the roller blind system to be of a modular structure in regard to the carrier members. In other words, the region of the profile channel 1*b* and the stamped-out lugs are always of the same configuration in different carrier members to that they always fit the same separate connecting elements 7. However the remainder of the configuration of the carrier member may vary greatly, for example in regard to size for adaptation to different winding diameters. However, even in the case of one and the same carrier member, by virtue of the numerous pre-bored through openings 11, it is possible to fix different kinds of draw-up mechanisms, mountings or the like, without altering the carrier member.

Figure 5:
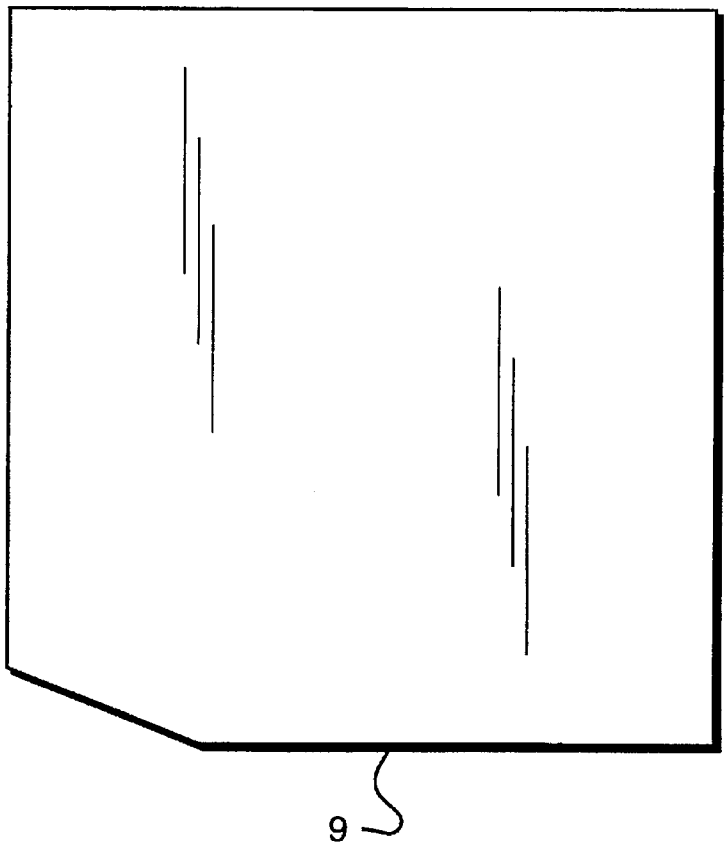
FIG. 5 is a side view of a lateral cover according to the present invention.

An embodiment of a flat cover plate 9 is shown in FIG. 5.

Figure 6:
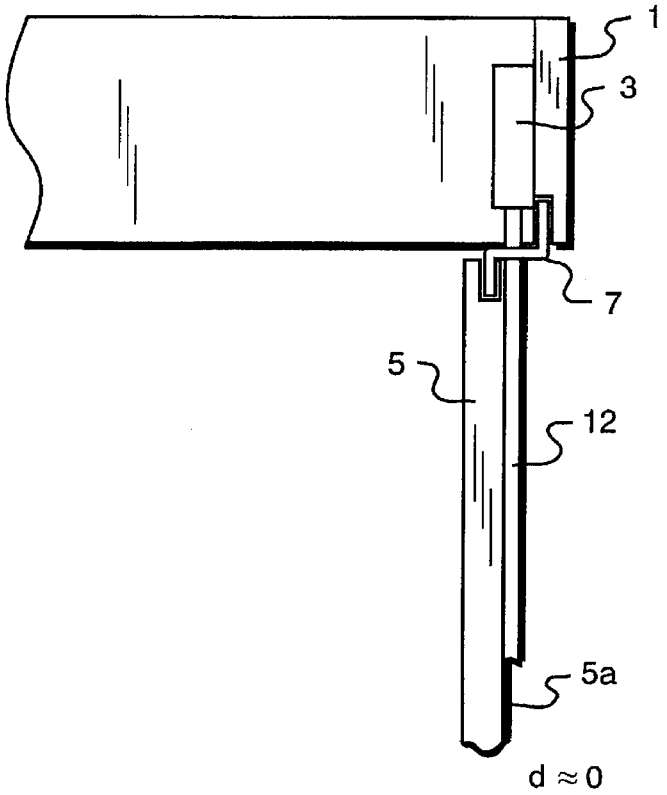
FIGS. 6 and 7 are front views of a section of a roller blind system according to the present invention showing separate embodiments for the connection of a lateral carrier member to a guide rail by means of a connecting element.
Figure 7:
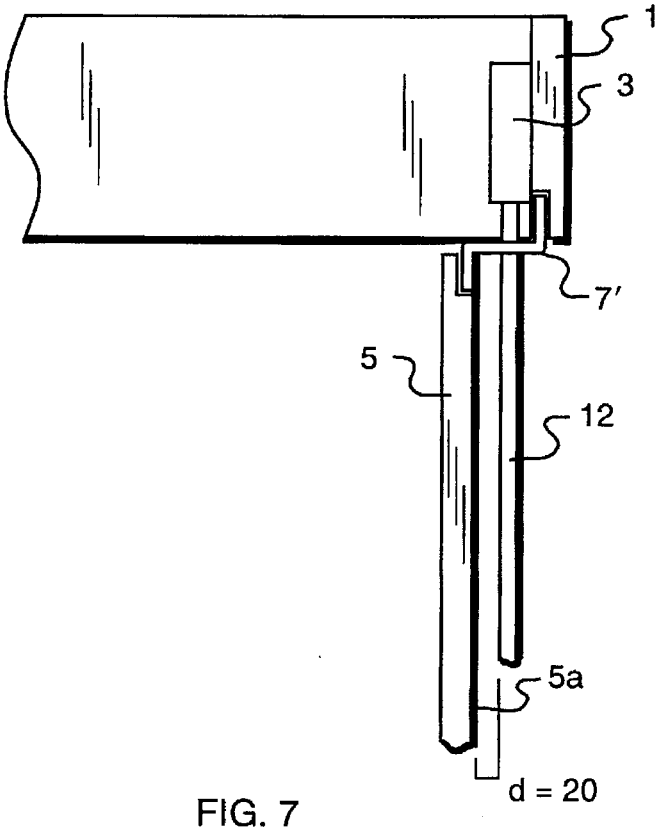

FIGS. 6 and 7 show how a different relative position as between the guide rail 5 and the carrier member 1 can be achieved by way of different separate connecting elements 7, 7' with the structure otherwise being the same. It is possible in that way to adapt the lateral spacing between a draw-up element 12 (for example a draw-up or raising belt) and the outside edge 5*a* of the guide rail, depending on local conditions. In FIG. 6 the spacing d is approximately zero, that is to say the draw-up element 12 extends substantially along the outside edge 5*a* of the guide rail 5. That is possible by virtue of a connecting element 7 which is of a Z-shaped profile and which is fitted both in the carrier member 1 and also in the guide rail 5, and which is releasably connected thereto. The releasable push-in connection is only diagrammatically shown in FIGS. 6 and 7. A larger spacing between the draw-up element 12 and the guide rail 5 is easily achieved by using a separate connecting element 7' which is also Z-shaped but which, as shown in FIG. 7, has a longer horizontal leg.

Figures 8A, 8B, 8C, 9A, 9B, 9C, 10A, 10B, 10C:
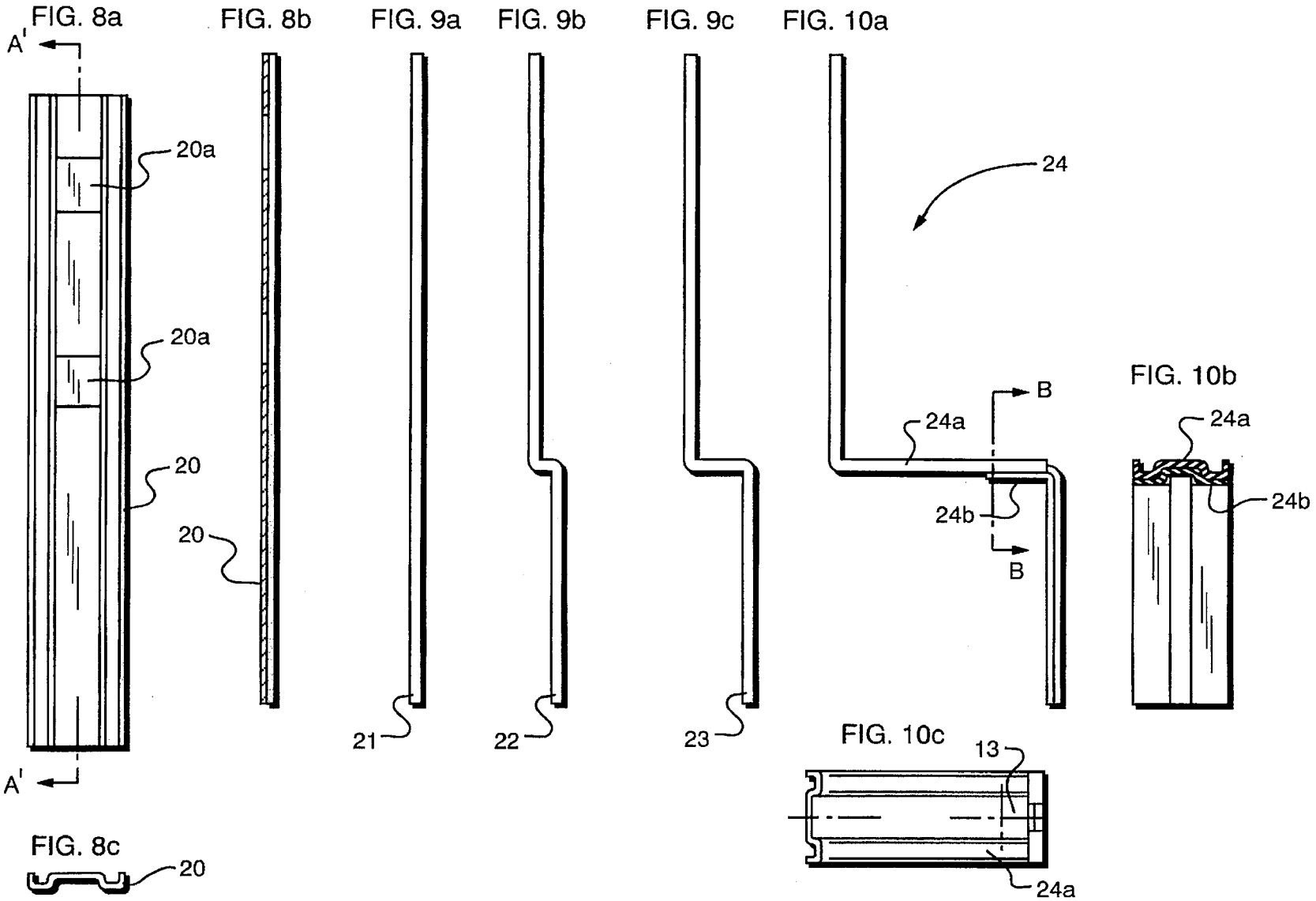
FIG. 8*a* is a front view of a profiled connecting element according to the present invention.
FIG. 8*b* is a sectional view of the connecting element of FIG. 8*a* taken along line A—A.
FIG. 8*c* is a top plan view of a of the connecting element of FIG. 8*a* which is straight in respect of its longitudinal extent.
FIGS. 9*a*–9*c* are side views of three separate embodiments of integral connecting elements according to the present invention.
FIG. 10*a* is a side view of and adjustable connecting element according to the present invention.
FIG. 10*b* is a sectional view of the adjustable connecting element of FIG. 10*a* taken along line B—B.
FIG. 10*c* is a top diagrammatic plan view of the adjustable connecting element of FIG. 10*a*.

In the embodiment shown in FIGS. 8*a* through 8*c* the separate connecting element 20 is overall straight, but it is profiled in cross-section (see in particular FIG. 8*c*) in order to increase stability. The connecting element may comprise, for example, metal or reinforced plastic material. In the embodiment shown in FIGS. 8*a* through 8*c* the connecting element 20 has two openings 20*a* which are suitable for being engaged into the lugs 10 in FIG. 3 from below. The connecting element 20 then lies snugly and fully in the profile channel 1*b*, as shown in FIG. 4.

Simple configurations of I-shaped 21 and Z-shaped 22, 23 connecting elements are shown in FIGS. 9*a* through 9*c*.

While the connecting elements shown hitherto were of a one-piece configuration and thus permit inexpensive manufacture, FIGS. 10*a* through 10*c* show a somewhat more expensive design. The connecting element 24 illustrated there is of a two-part configuration, wherein two L-shaped parts are assembled overall to form a Z-shaped connecting element. The horizontal leg 24*a* of the one part and the horizontal leg 24*b* of the other part overlap in the middle region, the degree of overlap being adjustable. In that way it is possible to adjust the effective length of the horizontal limb of the connecting element which overall is of a Z-shaped profile. A screw can serve for fixing the relative position of the legs 24*a* and 24*b*, the screw being screwed through both legs 24*a* and 24*b*, for example at the location indicated by a cross 13 in FIG. 10*c*.

Figure 11:
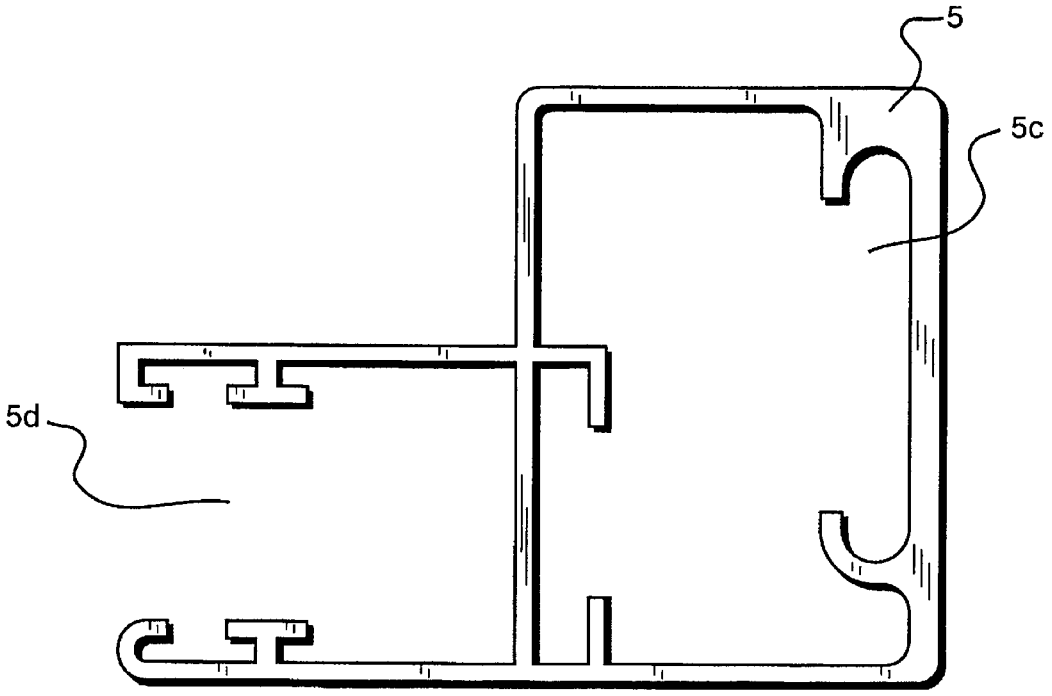
FIG. 11 is a top sectional view of a first embodiment of a guide rail according to the present invention.

Besides a set of different separate connecting elements or adjustable connecting elements, and possibly beside various carrier members which match, the roller blind system according to the invention may also have different kinds of guide rails in order to provide for optimum adaptation to the respective conditions involved. The guide rails are then distinguished in that they have a connecting region 5*c* which is always of the same configuration, irrespective of the rest of the structure of the guide rail, and which, therefore, always matches the same or similar separate connecting elements (see FIGS. 11 and 12). FIG. 11 shows an integral embodiment of a guide rail 5. The separate connecting element 7 can be inserted into the region 5*c* from above. The region 5*d* serves to guide a actual roller blind.

Figure 12:
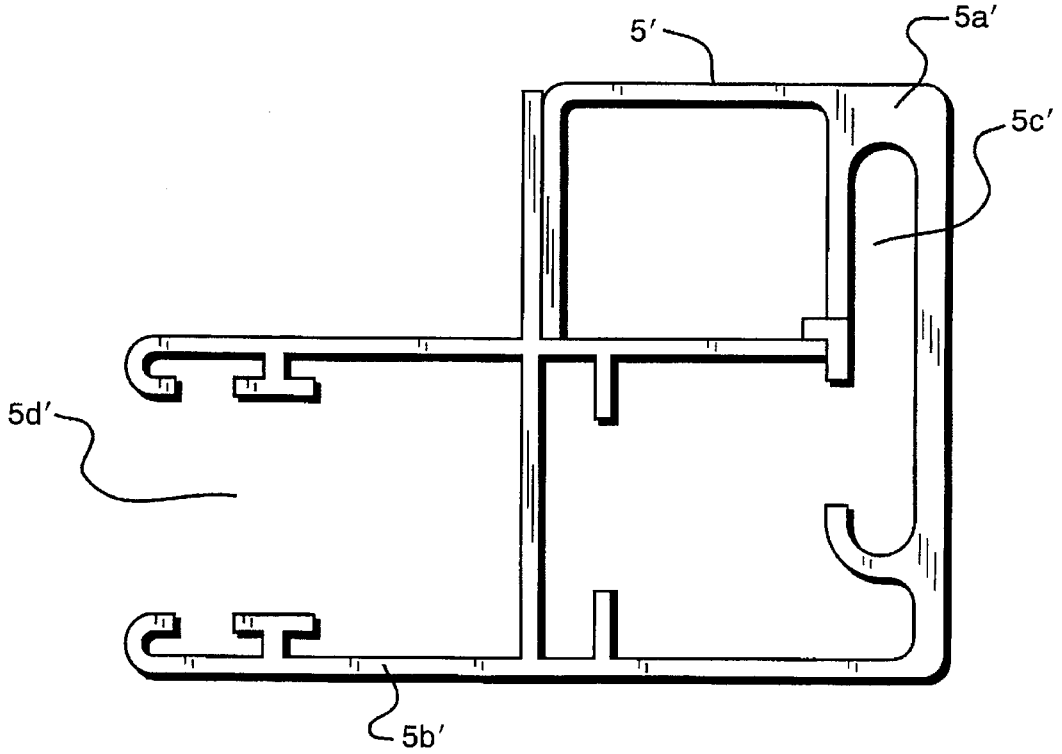
FIG. 12 is a top sectional view of a second embodiment of a guide rail according to the present invention.

FIG. 12 shows a two-part embodiment of the guide rail 5'. The first part 5*a'* has the connecting region 5*c'* for the connecting element 7, while the second part 5*b'* which is fixed thereto has the guide 5*d* for the actual roller blind shuttering. The two-part configuration shown in FIG. 12 advantageously makes it possible to fit different kinds of further parts 5*b'* to one and the same basic part 5*a'* with connecting region 5*c'*, depending on the roller blind thickness etc.

What is claimed is:

1. A roller blind system comprising:

at least two lateral carrier members for supporting a roller blind draw-up mechanism or mounting;

at least two lateral guide rails for guiding a roller blind shuttering; and a set of differently shaped connecting elements being realeasably connectable to at least one of said carrier members and to at least one of said guide rails, each connecting element of said set leading to a different lateral position between said at least one guide rail and said at least one carrier member.

2. A roller blind system according to claim 1, wherein at least one connecting element of said set is Z-shaped.

3. A roller blind system according to claim 1 wherein said system includes a plurality of different left-hand and right-hand ones of said guide rails, said guide rails having identical connecting regions for receiving each connecting element of said set.

4. A roller blind system according to claim 3 wherein said guide rails are respectively subdivided over their entire length into at least two parts, and wherein said connecting regions are provided in a first part of said guide rails, and a guide for said roller blind shuttering is provided in a second part of said guide rails.

5. A roller blind system according to claim 1, said system further comprising at least one functionally passive cover fixed on an outside surface of at least one of said carrier members.

6. A roller blind system according to claim 5 wherein each of said carrier members includes a plurality of different ones of said functionally passive covers which can be selectively releasably fixed to said carrier members.

7. A roller blind system according to claim 1 wherein said system includes a plurality of different ones of said carrier members which can be selectively fixed to said one of said guide rails by way of at least one connecting element of said set.

8. A roller blind system according to claim 7 wherein a plurality of different ones of said carrier members are selectively connected to said guide rails by connecting elements of said set which are substantially identical.

9. A roller blind system according to claim 7 wherein a plurality of different ones of said carrier members have substantially identical mounting means for at least one connecting element of said set for connecting said carrier members to said guide rails.

10. A roller blind system according to claim 1 wherein at least one of said carrier members comprises an endface and a substantially flat region set back inwardly relative to said end face, said flat region having a plurality of through openings therein, said through openings being adapted to receive screws for securing said draw-up mechanism or mounting to said at least one of said carrier members.

11. A roller blind system comprising:

at least two lateral carrier members for supporting a roller blind draw-up mechanism or mounting;

at least two lateral guide rails for guiding a roller blind shuttering; and at least one separate connecting element for connecting one of said guide rails to one of said lateral carrier members, wherein different relative lateral positions as between said one of said guide rails and said one of said carrier members are adjustable by way of said separate connecting element, wherein said at least one separate connecting element is of a multi-part structure, and wherein at least two parts of said multi-part structure are adjustable relative to each other to allow adjustment of said relative position.

12. A roller blind system according to claim 11 wherein said at least one separate connecting element includes two L-shaped parts, each of said L-shaped parts being formed of two L-limbs, wherein two of said L-limbs from different ones of said L-shaped parts partially overlap and by way of a releasable connection are selectively adjustable relative to each other with different degrees of overlap.

* * * * *